US006981902B1

(12) United States Patent
Tafoya et al.

(10) Patent No.: US 6,981,902 B1
(45) Date of Patent: Jan. 3, 2006

(54) MARINE REACTION THRUSTER

(76) Inventors: Samuel Barran Tafoya, 135 - 41st Circle E, Bradenton, FL (US) 34208; Hans Guenter Broemel, 2908 - 29th Avenue E, Bradenton, FL (US) 34208

( * ) Notice: Subject to any disclaimer, the term of this patent is extended or adjusted under 35 U.S.C. 154(b) by 0 days.

(21) Appl. No.: 10/700,027

(22) Filed: Nov. 3, 2003

(51) Int. Cl.
*B63H 11/103* (2006.01)

(52) U.S. Cl. ..... 440/47; 440/41; 440/43

(58) Field of Classification Search ..... 440/38, 440/40, 41, 42, 43, 46, 47; 60/221; 415/72
See application file for complete search history.

(56) References Cited

U.S. PATENT DOCUMENTS 3,040,696 A * 6/1962 Dahle ..... 440/46
3,250,072 A * 5/1966 Smith ..... 60/222
3,328,961 A * 7/1967 Aschauer ..... 60/222
3,405,526 A * 10/1968 Aschauer ..... 60/221
3,531,214 A * 9/1970 Abramson ..... 415/68
5,505,639 A * 4/1996 Burg ..... 440/42

* cited by examiner

*Primary Examiner*—Sherman Basinger
(74) *Attorney, Agent, or Firm*—Dorothy S. Morse

(57) ABSTRACT

A propulsion system designed to propel submarine and surface vessels by discharging fluid rearwardly with a reaction of increased force that is approximately twenty percent greater than that possible with conventional propeller systems. Its conical/tapered housing is mounted to the inside bottom surface and transom of a marine vessel hull whereby a keyhole-shaped inlet opening directs a large volume of seawater into the housing's wider end. Seawater then flows across several increasingly smaller propellers positioned within the housing. A reverse and steering assembly with a movable gate can be optionally aligned with the discharge end of the housing to control the direction of marine vessel movement. Size is not a limiting factor for the present invention and its operation is virtually silent. Also, its inlet opening is always below the water level so priming is never needed and no transmission is required. Recreational, commercial, and military applications are contemplated.

20 Claims, 7 Drawing Sheets

A= 10°-12° pitch angle
B= propeller circumference
C= propeller pitch – theoretical distance the propeller would advance in one revolution

MARINE REACTION THRUSTER

CROSS-REFERENCES TO RELATED APPLICATIONS

None.

BACKGROUND OF THE INVENTION

1. Field of the Invention

This invention relates to the field of propulsion systems for marine vessels, specifically to a propulsion system having a conical/tapered housing and a succession of increasingly smaller turbine/propeller blades each with a reduced pitch angle of between 10° and 12°, which is configured to propel a marine vessel by discharging fluid rearwardly with a thrust reaction of increased force that is approximately twenty percent greater than that produced by conventional propeller systems of comparable size. The wider end of the conical/tapered housing of the present invention, which is the suction side, is secured to the inside bottom surface of a marine vessel hull and has a bottom inlet opening aligned with an access hole through the hull, while the housing's opposing and narrowed discharge end is attached to the inside of the vessel's transom over a second hole. Preferably, an inlet opening cover plate with a keyhole-shaped opening is positioned flush within the outside bottom surface of the marine hull over its access hole, the keyhole shape being designed to disrupt the laminar flow of seawater under the hull and provide the inflow of a large volume of seawater through the inlet opening and into the wider end of the conical/tapered housing when the marine hull moves in a forwardly direction. For effective use, the narrow end of the keyhole-shaped opening must be placed in a position that faces the bow of the marine hull. Eddys form at the keyhole-shaped opening's rounded and tapering outside edges, which redirect the inertial energy of the seawater to flow upward into the conical/tapered housing at the center of the opening's leading edges, and the main flow of seawater to follow without protest. Due to the large amount of seawater induced by the keyhole-shaped opening to flow into the wider end of the conical/tapered housing, steam bubbles that are low in temperature and pressure are prevented from forming, and cavitation is eliminated as the seawater moves through the wider end of the conical/tapered housing toward the first propeller. Once drawn into the conical/tapered housing through the keyhole-shaped opening, the seawater is then directed across the succession of increasingly smaller turbine/propeller blades and discharged from the narrow end of the housing with increased thrust. The reduced pitch angle of each propeller blade, to a maximum that is between approximately 10° and 12°, further increases the efficiency of the present invention marine reaction thruster by creating a reduction in outgassing and cavitation as the seawater moves across the propeller blades. A reverse and steering assembly attached to the outside surface of the transom, and aligned with the discharge opening of the present invention, has a movable gate that controls the direction of forward/reverse movement of the associated marine hull. However, it is the speed of the inboard engine, which determines the velocity of the marine vessel associated with the present invention. When the gate is fully opened, the discharged seawater moves rearwardly through the reverse and steering assembly and the marine vessel moves in a forwardly direction. Correspondingly, when the gate is lowered, rearward movement of the seawater discharged from the conical/tapered housing and moving through the reverse and steering assembly is blocked, and the lowered gate instead forces all or a portion of the discharged seawater into a downward and forwardly direction under the marine vessel, which causes the vessel to stall or move in reverse. Rudders are also positioned within the reverse and steering assembly, and have Ackerman geometry to enhance the efficiency of making turns. Also, although the reverse and steering assembly runs best when it is above water, it still can be used effectively under water in surface and submarine vessels. Further, since each of the propeller blades positioned for rotation within the present invention's conical/tapered housing substantially fills its cross-sectional dimension, the propeller blade in the wider end of the conical/tapered housing necessarily has the largest diameter dimension and the propeller blade closest to the transom has the smallest diameter dimension. A debris-cutting member is preferably positioned in front of each propeller, and also preferably in front of the strut supporting the drive shaft upon which the propellers are mounted, to cut up pieces of seaweed, rope, and other debris in the seawater entering the conical/tapered housing that would otherwise accumulate into propeller-slowing clogs, as well as elongated strands of seaweed and/or other matter that would have a tendency to wrap itself around the propellers and/or strut and reduce thrust reaction efficiency. Size is not a limiting factor and the present invention marine reaction thruster can be enlarged or reduced in size during manufacture for varying applications. However, should the keyhole-shaped opening be sufficiently increased in size to place humans and large marine life at risk for being sucked into the conical/tapered housing during present invention use, safety precautions dictate that a grate and/or other appropriately configured means be secured across the inlet opening in a way that prevents large objects from entering the conical/tapered housing while at the same time continues to allow a large volume of seawater to enter it. Since the propulsion system of the present invention is enclosed within a marine hull and discharges fluid directly through a rear opening in its transom, its operation is virtually silent. In addition, the internal positioning of the present invention within the marine hull prevents propeller damage that might otherwise occur from contact with reefs, sandbars, and other underwater obstacles. Further, since no transmission is required, manufacturing cost is reduced. Recreational, commercial, and military applications are contemplated for both submarine and surface vessels.

2. Description of the Related Art

Standard drives for boats have certain disadvantages. For example, standard inboard engines have a tendency for excessive propeller slippage due to the angular geometry of their propeller installation, which worsens when the bow rises. When the pitch angle of a propeller becomes excessive, cavitation sets in and its operating efficiency is reduced. Standard outboard marine engines also have a similar excessive propeller pitch angle disadvantage, needed to compensate for their inability to accommodate large propellers. An excessive pitch angle in a propeller causes its blades to move faster through water than the water can close in behind them. This causes a vacuum to occur in the fluid flowing around the blades, and saturated steam is generated. The resulting cavitation and outgassing have a negative impact on the propeller's operating efficiency. Thus, current inboard and outboard marine propellers lose approximately thirty to forty percent of their operating efficiency as a result of the pitch angle of their blades being higher than needed. In contrast, the present invention propulsion system is designed to propel fluid by discharging it rearward beyond the transom of an associated marine vessel with a reaction of increased force that is approximately twenty percent greater than that created by conventional propeller systems of comparable size used in marine applications. The present invention is compact in configuration, has a conical/tapered housing, and preferably has a water inlet opening on its suction side with a keyhole-shaped configuration designed to induce a large volume of seawater into the wider end of the conical/tapered housing without cavitation. Further, the propeller blades of the present invention have increasingly smaller diameter dimensions that are successively positioned within the conical/tapered housing, and all are directly connected to an inboard motor via a common drive shaft. To avoid stalling of its propeller blades and prevent cavitation, each propeller has a maximum pitch angle between approximately 10° and 12°. As a result, since the volume of fluid moving across each successively smaller propeller blade is constant and each next smaller propeller must move more cubic inches of seawater per revolution than its adjacent larger propeller, the velocity of the seawater moving through the conical/tapered housing is successively increased and a thrust reaction is generated. A reverse and steering assembly aligned with the discharge opening of the conical/tapered housing has a movable gate that can be positioned to direct fluid discharged by the housing in a downward and forwardly direction under the associated marine vessel hull to provide it with reverse motion, while two crescent-shaped rudders each of semi-tubular design and located aft of the discharge opening provide steering for the marine vessel by laterally deflecting the discharged fluid after it exits the conical/tapered housing. Since the conical/tapered housing is located inside a marine hull, its propellers are protected from exterior damage, such as that due to contact with a reef or sandbar. The hull protection also prevents the propellers from causing injury to humans and large marine life, such as porpoises and manatees. Further, since the suction side of the present invention is through the bottom portion of the marine hull, it is always below water level and priming is never required. Also, no transmission is needed with present invention use. Thus, the present invention has many features and advantages not taught by the prior art, which assist the present invention in creating enhanced marine vessel operation.

BRIEF SUMMARY OF THE INVENTION—OBJECTIVES AND ADVANTAGES

The primary object of this invention is to provide a marine reaction thruster that enhances the operating efficiency of a marine engine at least twenty percent over that possible through the use of conventional propulsion systems of comparable size. It is also an object of this invention to provide a marine reaction thruster that is simple and cost effective to manufacture. A further object of this invention is to provide a marine reaction thruster that is easily and cost-effectively maintained. It is also an object of this invention to provide a marine reaction thruster with durable construction for long-term use. A further object of this invention is to provide a marine reaction thruster that is less dangerous to marine life than conventional propulsion systems. It is also an objective to provide a marine reaction thruster that is configured and positioned for reduced risk of damage by reefs, sandbars, and other underwater obstacles. A further object of this invention is to provide a marine reaction thruster having virtually silent operation, without vibration or propeller thumping.

As described herein, properly manufactured, and installed within the hull of a marine vessel, the present invention marine reaction thruster is designed to propel fluid by discharging it rearward with a reaction of increased force. This is accomplished by using a succession of increasingly smaller propellers mounted on the same drive shaft within a conical/tapered housing and ensuring that each propeller has a maximum the pitch angle of approximately 10° to 12°. Pitch angle is defined by the diagram in FIG. 16.

The constant volume of fluid moving across the successively smaller propellers, in combination with the decreasing cross-sectional dimension of the propeller housing, sequentially increases the velocity of the seawater moving through the housing as it passes each propeller. An example of how the present invention causes increased operating efficiency over conventional marine propulsion systems is identified below. If the first propeller of the present invention propeller would be made with a diameter dimension of approximately ten inches and a pitch of approximately five-and-one-half inches, it would move approximately one-hundred-seventy-one cubic inches of fluid in one revolution. The next smaller propeller mounted on the same drive shaft would then be approximately nine-and-one-fourth inches in diameter and have a pitch of approximately six-inches. Since the volume of the fluid passing the second propeller is the same as that moving past the first propeller, the velocity of the fluid has now accelerated approximately 1%, generating a thrust reaction for the fluid as it approaches the third propeller. Then, if the third propeller is made with a diameter dimension of approximately eight inches and a pitch of approximately six-inches, and if its overall pitch angle is maintained at approximately 11°30', the third propeller will further increase the velocity of the seawater moving rearwardly within the conical/tapered housing. When a fourth propeller is made with a diameter dimension of approximately seven-and-one-half inches and a pitch of approximately six-and-one-half inches, and its is mounted on the same drive shaft behind the other three propellers, and further where the discharge opening of the conical/tapered housing is approximately three inches in diameter (or approximately 9.42 square inches), the velocity of the one-hundred-seventy-one cubic inches of seawater as it exits the discharge opening is increased by approximately 20%. Further, as a result of the design of a keyhole-shaped opening in a cover plate mounted flush with the associated marine hull and aligned with the inlet opening of the present invention's conical/tapered housing, a large volume of seawater is drawn up into the conical/tapered housing without cavitation when the hull moves in a forwardly direction. The narrow end of the keyhole shape must face the bow of the associated marine hull, whereby the laminar flow of seawater across the forwardly moving hull is caused to form eddys at the outside edges on the narrow end of the keyhole-shaped opening and seawater to thereafter flow into the conical/tapered housing at the center of its leading edges, making a right angle or knee turn (genuflect) into the keyhole-shaped inlet opening. Rounded edges on the narrow end of the keyhole-shaped opening, will cause the eddys to form, and prevent the seawater from bypassing the opening. However, the efficiency of seawater inflow is increased by use of inwardly sloping edges adjacent to the narrow portion of the keyhole-shaped inlet opening. The larger and wider rear portion of the keyhole-shaped opening can also be angled or otherwise made sloping on its rear top surface to enhance upward seawater flow into the conical/tapered housing and maximize efficiency. Thus the eddys which are formed in the narrow end of the keyhole-shaped inlet opening redirect the inertial energy of the laminar flow to move upward (genuflect) into the conical/tapered housing of the present invention and thereby induce the main flow of seawater to follow without protest. Due to the large amount of seawater induced to flow into the keyhole-shaped inlet opening, which prevents steam bubbles that are low in temperature and pressure from forming, cavitation is eliminated as the seawater moves toward the first propeller. Also, the present invention is easily maintained. The need to clean drag-producing debris from the present invention propeller blades, or the strut that supports the distal end of the drive shaft upon which the propellers are mounted, is reduced when a debris-cutting blade is positioned for rotation in front of one or more of the propellers, and optionally in front of the strut. The debris cutter in front of the strut may be larger that those positioned in front of the propellers. Since it is contemplated for the motor connected to the drive shaft to always have a right-hand rotation, all components affected by drive shaft rotation will also have a right-hand configuration, including the positioning of the cutting edges on each debris cutter used. Also, the front casting, inlet opening cover plate, and strut plate are removable for easy maintenance access to the strut, drive shaft, and propellers. In addition, failure of the present invention propellers is reduced since they are internally located within a protective conical/tapered housing that is further protected by a marine hull. Thus, unless there is a hull breach, the propellers are unavailable for direct contact with large marine life or underwater objects such as reefs and sand bars. Further, the fact that no transmission is required allows for a simple construction, and the present invention has a nearly silent operation that could benefit submarine vessels used in research and military applications. However, since no transmission is present, a change in the direction of movement for the marine hull associated with the present invention is preferably accomplished by a reverse and steering assembly positioned rearward from the discharge opening, which includes opposing rudders having Ackerman geometry that allows one rudder to move more that the other while the associated marine hull is making a turn and the second rudder to move more than the first while making a turn in the opposite direction, for less disruption of the water and enhanced operating efficiency. Rearward movement of the associated marine hull is also simply accomplished by use of a movable gate within the reverse and steering assembly that deflects the seawater flowing rearwardly from the conical/tapered housing into a downward and forwardly direction under the hull. Sturdy, non-corrosive materials, and oversized fasteners, further make the present invention durable for long-term use.

While the description herein provides preferred embodiments of the present invention, it should not be used to limit its scope. For example, variations of the present invention, while not shown and described herein, can also be considered within the scope of the present invention, such as variations in the number of propeller blades used within the conical housing; the materials used for manufacture of the conical/tapered housing; the number, size, configuration, type, and positioning of bolts and/or other fasteners used to attach components of the present invention together and the conical/tapered housing in its usable position against the inside surfaces of the marine hull bottom and its transom; the length and width dimensions of the keyhole-shaped opening used to induce a large volume of seawater (genuflect) through the bottom surface of the associated marine hull as long as such dimensions remain in substantial proportion to the keyhole-shaped configuration shown and described herein; the safety precaution means used to prevent large objects from entering the keyhole-shaped opening in the marine hull in very large embodiments of the present invention, and the number of present invention thrusters that can be used in association with larger marine hulls, such as a submarine. Thus, the scope of the present invention should be determined by the appended claims and their legal equivalents, rather than being limited to the examples given.

DETAILED DESCRIPTION OF THE INVENTION

Figure 1:
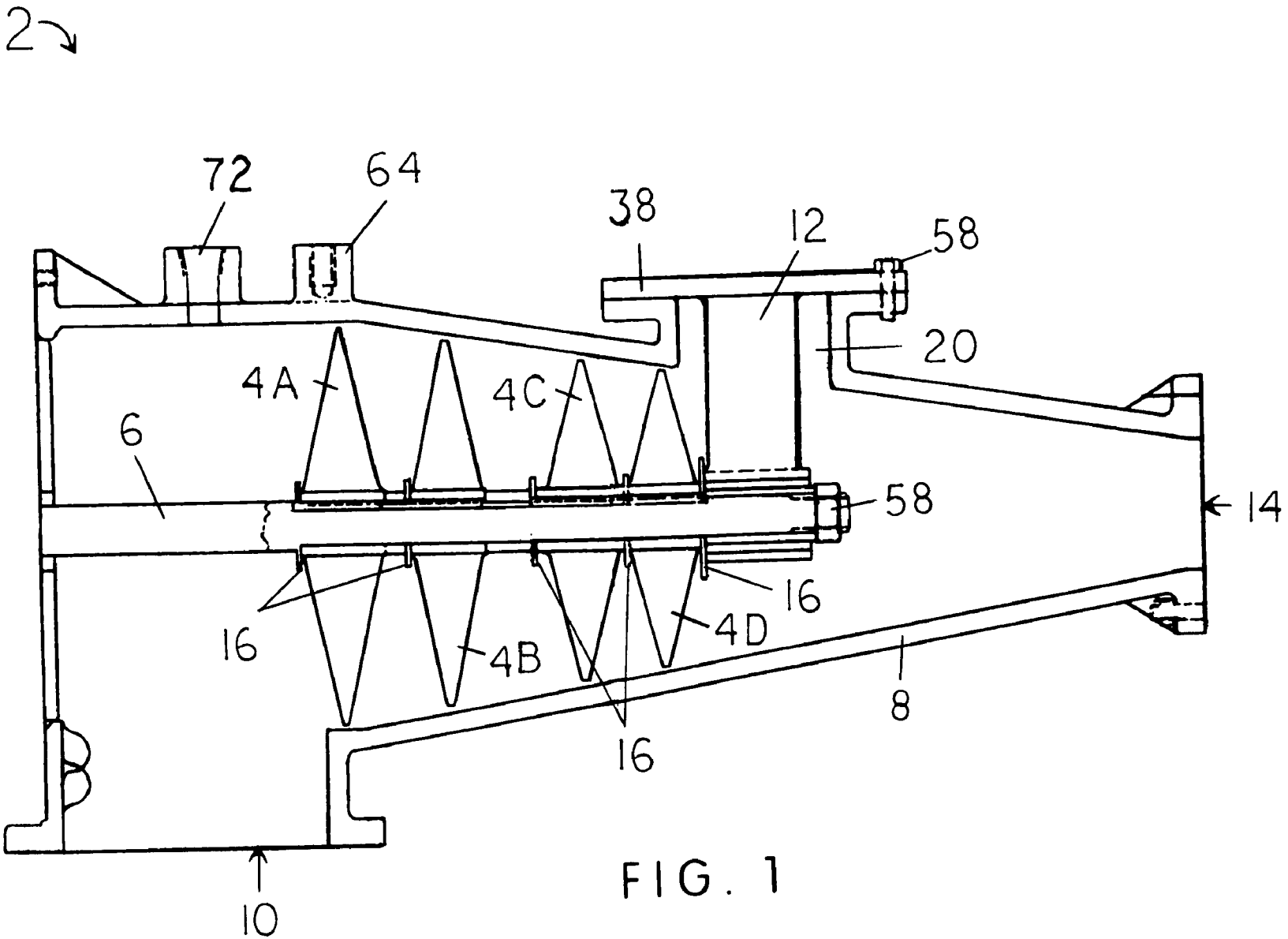
FIG. 1 is a side view of the most preferred embodiment of the conical/tapered propeller housing in the present invention marine reaction thruster with four successively smaller propellers mounted on the same drive shaft, the inlet opening on the suction side of the housing being adjacent to the largest propeller, and a strut that supports the distal end of the drive shaft being mounted in a fixed position within the propeller housing by use of a strut plate secured over an upper access opening located between the smallest propeller and the discharge opening at the narrow end of the conical/tapered housing.
Figure 16:
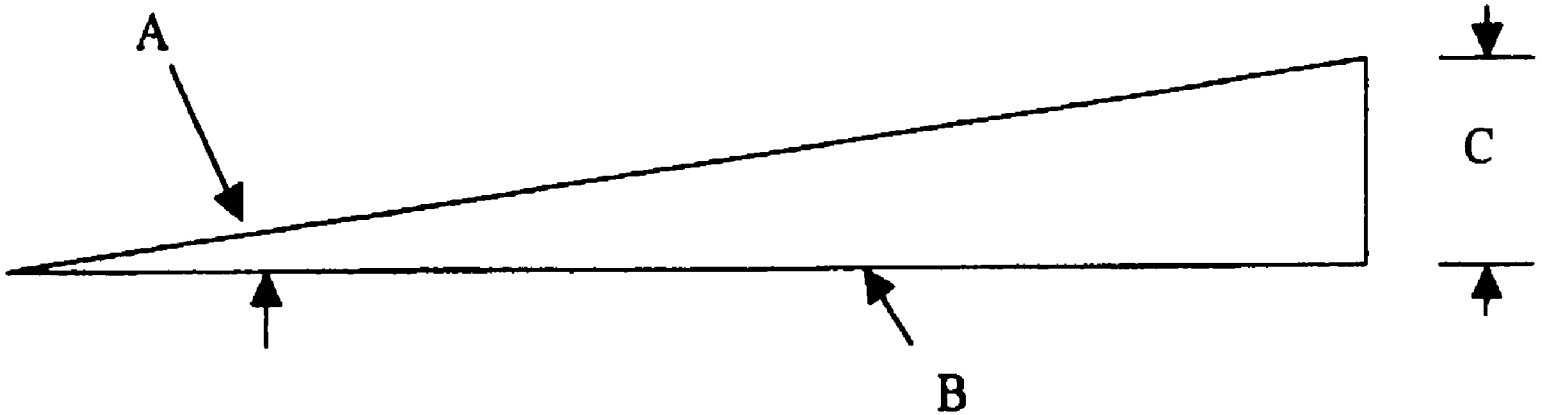
FIG. 16 is diagram defining the maximum pitch angle for each of the increasingly smaller propellers of the present invention that are mounted on the same drive shaft within a conical/tapered housing.

The present invention is a propulsion system designed to move a marine vessel (represented only by hull 24 and transom 36) by discharging seawater rearwardly with a reaction of increased force that is approximately twenty percent greater than conventional propeller systems of comparable size (not shown). Mounting of the wider end of the conical/tapered housing 8 of the present invention, its suction side, is contemplated against the inside of bottom surface 24 of an associated marine hull, with the narrow discharge end of conical/tapered housing 8 being attached to the inside surface of the transom 36. Below its wider end, conical/tapered housing 8 has an inlet opening 10. An inlet opening cover plate 28 with a central keyhole-shaped opening 32 is connected to the outside of bottom surface 24, in a position aligned with inlet opening 10 and flush with the outside of bottom surface 24, whereby the keyhole-shaped opening 32 is designed to the inflow of a large volume of seawater into the wider end of conical/tapered housing 8 without cavitation when the marine vessel moves in a forwardly direction, with the seawater (shown via arrows in FIG. 7) thereafter being directed across a succession of increasingly smaller turbine/propeller blades 4A–4D attached to a common shaft 6, then exiting the narrow end of housing 8 through discharge opening 14. To prevent cavitation and avoid stalling of its propeller blades 4A–4D, each propeller 4A–4D is installed with a maximum pitch angle of approximately ten to twelve degrees, being defined in terms of the propeller's circumference and the theoretical distance the propeller would advance in one revolution (as shown in FIG. 16). As a result, since the volume of fluid passing by each successively smaller propeller blade 4B, 4C, or 4D is constant and each next smaller propeller 4B, 4C, or 4D must move more cubic inches of seawater per revolution than its adjacent larger propeller 4A, 4B, or 4C, the velocity of the seawater through conical/tapered housing 8 is increased and a thrust reaction is generated. An upwardly directed strut 12 positioned between the smallest propeller blade 4D and discharge opening 14 secures the distal end of shaft 6 centrally within conical/tapered housing 8. To control the direction of movement of the associated marine vessel, in the most preferred embodiment 2 of the present invention a reverse and steering assembly 34 with a movable gate 48 is attached to outside surface of transom 36 and aligned with discharge opening 14. When gate 48 is fully opened, the marine vessel moves in a forwardly direction. However, as gate 48 is lowered, rearward discharge of the seawater behind reverse and steering assembly 34 is at least partially blocked, instead forcing all or a portion of the discharged seawater into a downward and forwardly direction under the marine vessel, which causes forward motion of the vessel to cease, or reverse vessel movement to occur. While the crescent-shaped rudders 42 positioned within reverse and steering assembly 34 have Ackerman geometry to cause less disruption of water for enhanced efficiency during turns, with one rudder moving more than the other for a turn in one direction and vice versa for a turn in the opposing direction, the velocity of marine vessel movement is regulated by the speed of an inboard engine connected via drive shaft 6 to propellers 4A–4D. Steering via rudders 42 can take place while the marine vessel is moving forward or in reverse. Further, since each propeller blade 4A–4D positioned for rotation within conical/tapered housing 8 substantially fills the cross-sectional dimension of housing 8, propeller blade 4A in the wider end of conical/tapered housing 8 necessarily has the largest diameter dimension and propeller blade 4D, which is closest to transom 36, would have the smallest diameter dimension. Strut 12 secures the distal end of drive shaft 6 centrally within conical/tapered housing 8. Also, the reduced maximum pitch angle of each propeller blade 4A–4D to between ten and twelve degrees increases present invention efficiency by creating a reduction in outgassing and cavitation of the seawater moving through conical/tapered housing 8. Further, a debris-cutting member 16 is preferably employed in front of each propeller blade 4, and optionally in front of strut 12, to cut up pieces of seaweed, rope, and/or other debris in the seawater entering conical/tapered housing 8 and thereby prevent propeller-slowing clogs and elongated objects (not shown) from becoming wrapped around propellers 4A–4D or strut 12 and impeding seawater flow through housing 8. The debris-cutting members 16 associated with each propeller, 4A–4D and strut 12 can have the same or different configuration and dimension from the other debris-cutting members 16, however, each debris-cutting member 16 should not be so large relative to the propeller 4 immediately behind it as to block efficient flow of seawater across that propeller 4. FIG. 1 shows the debris-cutting member 16 in front of strut 12 being larger that the debris-cutting members 16 in front of propellers 4A–4D. However, this is not critical. Further, size is not a limiting factor for the present invention and it can be enlarged or reduced in dimension during manufacture to provide optimum propulsion benefit for nearly any size of marine vessel targeted for use therewith. However, when the size of the keyhole-shaped opening 32 through inlet opening plate 28 increases sufficiently to place humans and large marine life (not shown) at risk for being sucked into conical/tapered housing 8 during present invention operation, it is contemplated for a grate (not shown) and/or other appropriately configured means to be secured across inlet opening 32 so as to prevent large objects from entering housing 8 while at the same time continuing to allow a large volume of seawater to enter the suction side of housing 8 without cavitation. Further, since the present invention propulsion system is enclosed within housing 8, which is positioned within a marine hull 24 and discharges fluid efficiently through a rear discharge opening 14 without the need for a transmission, its operation is virtually silent. In addition, the internal positioning of propellers 4A–4D reduces the possibility of them being damaged by contact with reefs, sandbars, and other underwater obstacles (not shown). Further, since no transmission is required, manufacturing cost is reduced. Recreational, commercial, and military applications are contemplated for both submarine and surface vessels.

Figure 5:
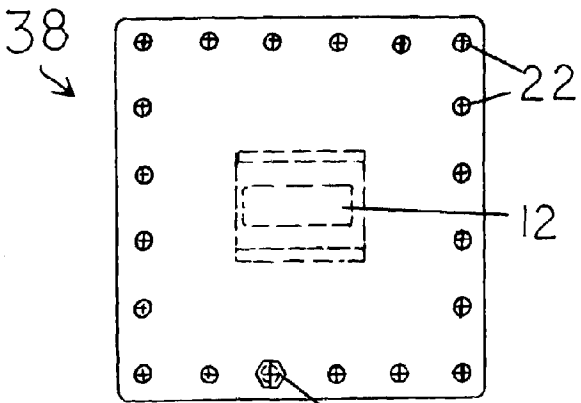
FIG. 5 is a plan view of the strut plate used over a rectangular access opening through the upper portion of the conical/tapered propeller housing of the most preferred embodiment of the present invention marine reaction thruster, with a plurality of fastener openings in a rectangular pattern being positioned near the perimeter of the strut plate, and the proximal end of the strut that is connected to the reverse side of the strut plate and used for supporting the distal end of the drive shaft upon which the propellers are mounted being centrally positioned and shown in broken lines.
Figure 2:
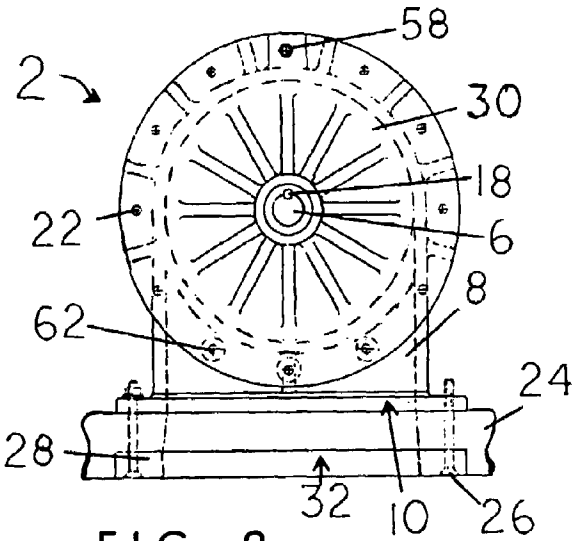
FIG. 2 is a front end view of the elongated front casting of the most preferred embodiment of the present invention, also shown in FIG. 7, with a drive shaft extending centrally therethrough and the circular perimeter of its wider end being secured to the wider end of the conical/tapered propeller housing shown in FIG. 1 via a plurality of sturdy and perhaps oversized fasteners, a portion of the conical/tapered propeller housing also extends downwardly below the front casting with the bottom surface of the hull of an associated marine vessel being secured between the housing extension and an inlet opening cover plate, such as that shown in FIG. 4, which is mounted flush with the outside surface of the hull.
Figure 4:
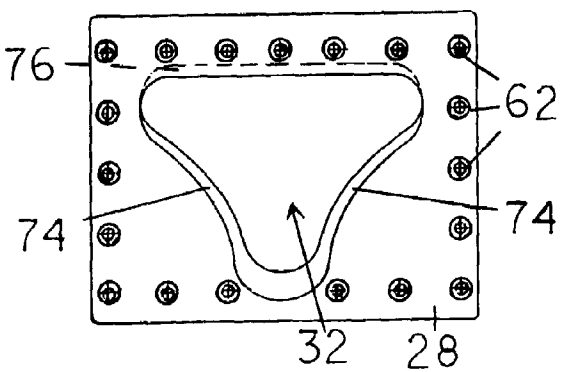
FIG. 4 is a front view of the inlet opening cover plate used on the suction side of the most preferred embodiment of the present invention marine reaction thruster over the inlet opening of the conical/tapered housing, with a plurality of recessed apertures around its perimeter that allow it to be placed flush within the bottom surface of a marine hull for most efficient and effective use, and its centrally positioned keyhole-shaped opening having tapering outside edges on its narrow end that cause a large volume of fluid to flow into the wider end of its conical/tapered housing without cavitation, the narrow end of the keyhole-shaped opening necessarily being positioned toward the bow of the marine hull into which it is mounted for maximum disruption of the laminar seawater flowing under the forward moving hull.
Figure 7:
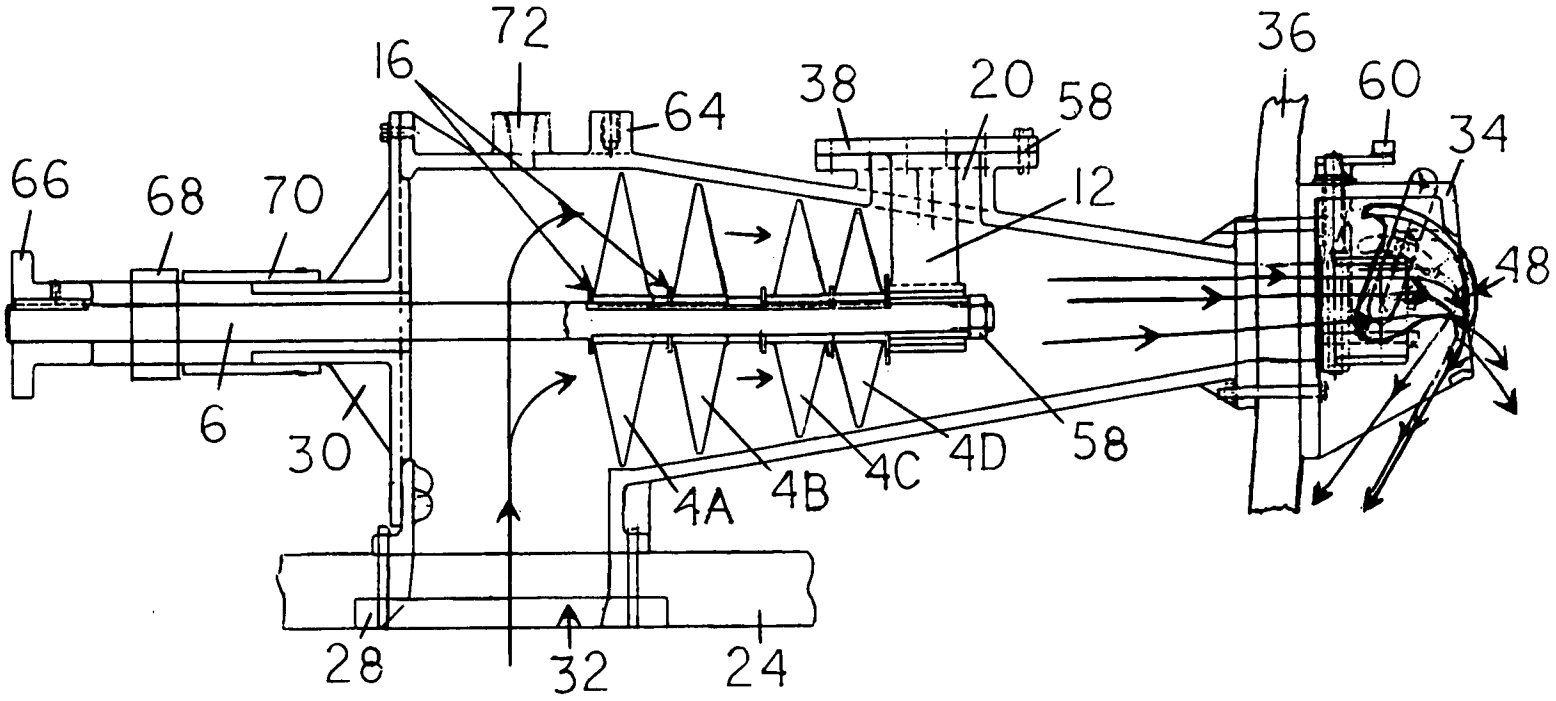
FIG. 7 is a side view of the conical/tapered propeller housing in the most preferred embodiment of the present invention marine reaction thruster being secured between the bottom inside surface of a marine hull, a front casting supporting a drive shaft that extends into the housing, and the inside surface of the hulls' transom, with arrows showing the direction of fluid flow into the conical/tapered housing, across the propellers, through the narrow end of the conical/tapered housing, beyond the transom, and outwardly beyond the reverse and steering assembly attached to the outside surface of the transom and aligned with the conical/tapered housing, with the gate of the reverse and steering assembly partially closed to redirect some of the fluid downward and forwardly under the associated marine hull.

FIG. 1 shows the conical/tapered housing 8 of the most preferred embodiment 2 of the present invention marine reaction thruster having four propellers 4A, 4B, 4C, and 4D mounted on a single drive shaft 6 centrally located within a conical/tapered housing 8, with propellers 4A–4D substantially filling the cross-sectional diameter dimension of conical/tapered housing 8. Propellers 4A, 4B, 4C, and 4D are successively smaller in size, with propeller 4A being the largest and positioned near inlet opening 10, with propeller 4D being the smallest and closest in position to discharge opening 14. Although not readily evident in the side view provided in FIG. 1, propellers 4A, 4B, 4C, and 4D are also each installed to create a maximum pitch angle of 10° to 12°. A conical/tapered configuration for the interior portion of housing 8 between first propeller 4A and discharge opening 14 is critical, although a conical/tapered configuration for the outer surface of housing 8 is preferred but not critical. Further, although the use of exactly four propellers 4A–4D is not critical to the creation of a marine thrust reaction, the number of propellers 4 used does have an affect on the amount of increased force created and should be taken into consideration during a pre-construction evaluation of the design requirements for each intended application. Thus, it is considered to be within the scope of the present invention for more and less than four propellers 4 to also be used. Further, although not limited thereto, many types of common inboard propellers can be used within conical/tapered housing 8, such as but not limited to those manufactured by the General Propeller Company and having three or more blades. For most applications, using more than three blades per propeller 4 is advantageous. Five debris cutting members 16 are also shown mounted on drive shaft 6, with one located in front of each propeller 4A, 4B, 4C, and 4D, and a larger one in front of strut 12, so that debris such as elongated pieces of rope and seaweed in the seawater drawn into housing 8 through inlet opening 10 on the suction side are prevented from wrapping around the propeller 4 or strut positioned directly behind it, for more efficient operation and reduced maintenance. The size, configuration, number, and positioning of debris cutting members 16 is not critical, as long as they are appropriate to the need. As shown in FIGS. 2 and 4, it is contemplated in most preferred embodiment 2 for an inlet opening cover plate 28 with a keyhole-shaped opening 32 to be secured over fluid inlet opening 10, with the narrow end of the keyhole-shaped opening 32 necessarily facing the bow of its associated marine hull and being configured with tapering outside edges that cause eddys to form that redirect the inertial energy of the seawater flowing in laminar across bottom surface 24 as it moves in a forwardly direction and cause that seawater to make a right angle or knee turn across the center of the leading edge of keyhole-shaped opening 32. As the inertial energy of the seawater is redirected to move upward and into the wider end of conical/tapered housing 8, it does so without cavitation and it further induces the main flow of seawater to follow without protest. Although in FIG. 1 the position of a marine vessel hull is not shown relative to conical/tapered housing 8, a section of the bottom surface 24 of a marine hull is shown in FIG. 7 with the portion of conical/tapered housing 8 around inlet opening 10 mounted against the inside of bottom surface 24. In FIG. 7, the portion of conical/tapered housing 8 around discharge opening 14 is shown mounted against the inside surface of transom 36. In addition, FIG. 1 shows a strut 12 supporting the distal end of drive shaft 6 centrally within conical/tapered housing 8. Strut 12 is secured in position relative to conical/tapered housing 8 via a strut plate 38 mounted over upper access opening 20. In FIG. 5, one can see that it is contemplated for a plurality of fasteners 58 to connect strut plate 38 to conical/tapered housing 8. Strut 12 is mounted behind the smallest propeller 4D in the narrow end of conical/tapered housing 8. FIG. 1 further shows a fastener/nut 58 helping to maintain the connection of strut 12 to the distal end of drive shaft 6 during operation of propellers 4A–4D. While the configuration and dimension of strut 12 is not critical, strut 12 should be sufficient in size and constructed of sturdy material so as to maintain propellers 4A–4D in their centrally located position within conical/tapered housing 8 during their high speed rotation. Also, on the upper surface of conical/tapered housing 8, at a spaced-apart distance forward from strut plate 38, FIG. 1 shows an optional handling device 64 that can be configured for mating with a tool or device (not shown) that assists in manipulation of conical/tapered housing 8 during manufacture and/or installation. Further, adjacent to handling device 64, FIG. 1 also shows an optional inlet opening 72 for optional introduction of engine cooling water into the suction side of conical/tapered housing 8. The size of conical/tapered housing 8 and propellers 4A–4D can be enlarged or reduced proportionally for use with any size of submarine or surface vessel, and its near silent operation provides an advantage for submarine vessels used in research and military applications. Since the present invention is simple in structure, with relatively few parts, it would be cost effective to manufacture when compared to the expense of prior art propulsion systems. Also, since its propellers 4A–4D are enclosed within conical/tapered housing 8 and positioned within a marine hull 24, the present invention is less dangerous to man and large marine life that convention propulsion systems. Further, for larger keyhole-shaped openings 32 in very large embodiments of the present invention, safety precautions would dictate that a grate (not shown) and/or other deterring means would be added over at least a portion of keyhole-shaped opening 32 to prevent humans and large marine life from being drawn through fluid inlet opening 10 and into the wider end of conical/tapered housing 8. The internal positioning of its propellers 4A–4D within conical/tapered housing 8 also places them at a reduced risk for damage that would otherwise occur as a result of contact with reefs, sandbars, and other marine obstacles. It is further contemplated for all of the components of the present invention marine reaction thruster in contact with the seawater drawn therethrough to be made from materials resistant to seawater exposure. The size of upper access opening 20 could vary from that shown, as long as it provides an appropriate dimension for ease of maintenance access to strut 12, fastener/nut 58, the debris-cutting member 16 adjacent to strut 12, and propeller 4D. Further, the dimension of inlet opening 10 can also be varied from that shown in FIG. 1, as long as sufficient seawater can be brought into conical/tapered housing 8 without cavitation and outgassing to create the anticipated amount of marine thrust reaction.

The ability of the present invention marine reaction thruster to propel a marine vessel by discharging seawater rearwardly therefrom with a reaction of increased force, is accomplished by passing a constant volume of fluid/seawater across increasingly smaller propellers 4A–4D that are installed with a maximum pitch angle of between ten and twelve degrees in conical/tapered housing 8 that has a decreasing cross-sectional dimension, whereby the velocity of the seawater moving through conical/tapered housing 8 is increased over that possible by conventional prior art propulsion systems since the reduced pitch angle of the propellers prevent outgassing and cavitation. An example of the dimensions and flow rates that would allow the present invention to create such a thrust reaction is outlined below, although larger and smaller dimensions and flow rates are also considered to be within the scope of the present invention. Should propeller 4A be made with a diameter dimension of approximately ten inches and have an approximate pitch of five-and-one-half inches, it will move approximately one-hundred-seventy-one cubic inches of seawater in one revolution. Propeller 4B mounted on the same drive shaft 6 behind propeller 4A, would then be approximately nine-and-one-fourth inches in diameter with a pitch of approximately six-inches. Since the volume of the seawater passing propeller 4B is the same as that moving across propeller 4A, the velocity of the seawater has now accelerated approximately 1%, generating a thrust reaction for the seawater approaching the third propeller 4C. Then, if propeller 4C is made with a diameter dimension of approximately eight inches and has a pitch of approximately six-inches, and its overall pitch angle is maintained at approximately 11°30', propeller 4C will further increase the velocity of the rearwardly moving seawater. When the fourth propeller 4D is made with a diameter dimension of approximately seven-and-one-half inches and a pitch of approximately six-and-one-half inches, and is mounted on the same drive shaft 6 behind the other three propellers 4A–4C, and further when discharge opening 14 is approximately three inches in diameter (or approximately 9.42 square inches), the speed of the one-hundred-seventy-one cubic inches of seawater as it exits discharge opening 14 is being increased by approximately 20%. Since drive shaft 6 always rotates in one direction and there is no transmission, changes in the direction of movement of the marine hull 24 are preferably accomplished by a reverse and steering assembly 34 positioned rearward from and aligned with discharge opening 14, which includes rudders 42 having Ackerman geometry wherein one opposing rudder 42 is moved more that the other during a turn for less disruption of water and greater operating efficiency, with the other opposing rudder 42 being moved more in a turn in the opposite direction. Rearward movement of a marine hull 24 associated with the present invention is accomplished by use of a movable gate 48 that deflects the rearwardly flowing seawater in a downward and forwardly direction under hull 24. Steering with rudders 42 can occur while the marine vessel is moving in reverse. Further the present invention has no transmission and a nearly silent operation that could benefit submarine vessels used in research and military applications. Also, since the propellers 4A–4D are inside a marine hull 24, they are not able to injure large marine life and their operation is unaffected by contact with underwater objects, such as reefs and sand bars.

The number of propeller blades 4 used in the conical/tapered housing 8 can be varied, as can the materials used for the manufacture of propeller blades 4 and the conical/tapered housing 8. Bronze casting and stainless steel are preferred materials, however, any non-corroding material having the strength characteristics of bronze or stainless steel could also be used. Further, the number, size, type, and positioning of fasteners 58 used to attach the conical/tapered housing 8 in its usable position against the bottom surface 24 and transom 36 of a marine hull are not critical, as long as conical/tapered housing 8 is securely positioned during its operation with leak proof connection of inlet opening 32 and discharge opening 14 to the marine hull. The length and width dimensions of keyhole-shaped opening 32 can also be enlarged and reduced for adaptation to different sizes of marine vessels, however, such dimensions must remain in proportion to that shown in FIG. 4 for maximum efficiency of the seawater inflow over the center of the leading edges in the narrow end of keyhole-shaped opening 32 so as to induce the main flow of seawater to follow without protest. Further, the type of safety means used to prevent large objects from entering keyhole-shaped opening 32 in larger embodiments of the present invention is not critical, as long as it continues to permit a large volume of seawater to be drawn through the inlet opening 10 on the suction side of conical/tapered housing 8. In addition, it is contemplated for more than one present invention marine reaction thruster to be used in association with larger marine hulls 24.

FIG. 2 shows the front end of the most preferred embodiment 2 of the present invention with conical/tapered housing 8 positioned behind front casting 30. The lower portion of conical/tapered housing 8, which contains inlet opening 10, extends below front casting 30 and is mounted against the inside of the marine hull's bottom surface 24. FIG. 2 also shows drive shaft 6 centrally positioned through front casting 30 and having a key 18 that is used for non-slip rotation of propellers 4 and debris cutting members 16, with front casting 30 having a plurality of apertures 22 around its perimeter for connection to the wider end of the conical/tapered housing 8 hidden behind it. While a fastener 58 is shown through one aperture 22, its is contemplated for all apertures 22 to have fasteners 58 inserted through them for secure connection of front casting 30 to conical/tapered housing 8 during use. Further, while the number of apertures 22 used in front casting 30 is not critical, the number of apertures 22 and fasteners 58 should be sufficient to securely connect front casting 30 in a leak proof manner to conical/tapered housing 8. In addition, the three fastener holes 62 near the bottom of front casting 30 are shown to have a recessed configuration, required by the adjacent external structure of conical/tapered housing 8. In a position below front casting 30, FIG. 2 also shows a recessed cover plate 28 attached to the outside of bottom surface 24 in a position aligned with inlet opening 10. As is shown in FIG. 4, cover plate 28 has a centrally located keyhole-shaped opening 32 which prevents the seawater in the laminar flow under bottom surface 24 from bypassing conical/tapered housing 8. Although not numbered, broken lines in FIG. 2 show that bottom surface 24 has a hole therethrough that allows fluid communication between keyhole-shaped opening 32 and inlet opening 10.

Figure 3:
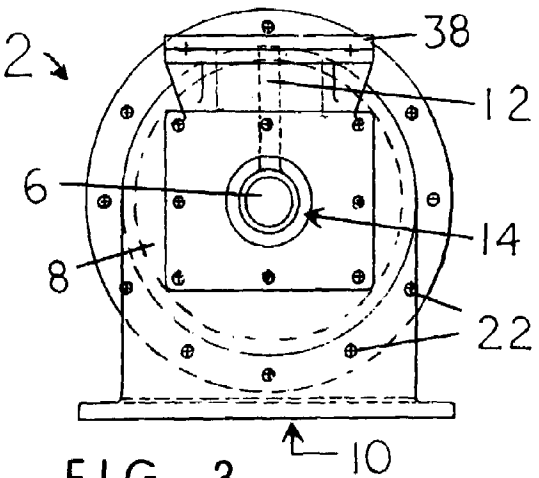
FIG. 3 is a rear end view of the conical/tapered propeller housing in the most preferred embodiment of the present invention, with the reverse and steering assembly removed, the fasteners openings in a central rectangular configuration being used for alignment and connection of the discharge opening to the transom and the reverse and steering assembly, and the fastener openings in a circular configuration about its perimeter being used to connect the wider end of the conical/tapered housing to the front casting.

FIG. 3 shows the conical/tapered housing 8 in the most preferred embodiment 2 of the present invention from its narrowed discharge end, with the reverse and steering assembly 34 (shown in FIGS. 7 and 9–15) removed to reveal drive shaft 6 centrally behind discharge opening 14. Strut 12 is shown extending in an upwardly direction from its connection to the distal end of drive shaft 6, with its top end being connected to a strut plate 38 that is secured over an access opening (shown by the number 20 in FIG. 1) in an upward extension of conical/tapered housing 8. FIG. 3 also shows the portion of conical/tapered housing 8 having inlet opening 10 extending in a downwardly direction below the conical/tapered portion of housing 8. Ten fastener openings 22 are visible in FIG. 3 in a circular configuration, with two additional fastener openings 22 being hidden behind strut plate 38. The circular pattern of fasteners openings 22 are used to secure conical/tapered housing 8 to the front casting 30 hidden behind it. Nine other fastener openings 22 are shown in FIG. 3 in a rectangular configuration, and are used to secure conical/tapered housing 8 to the transom 36 of a marine vessel (not shown). The number of fasteners openings 22 is not critical as long as sufficient to provide a secure, leak proof connection for conical/tapered housing 8. Further, the type of bolt 58 or other fasteners used within fastener opening 22 is not critical or limited to the type of fasteners shown in FIGS. 1–15. Thus, oversized fasteners can optionally be used to enhance durability according to need.

FIG. 4 shows the keyhole-shaped opening 32 in the cover plate 28 secured to conical/tapered housing 8 over the inlet opening 10 in most preferred embodiment 2 of the present invention marine reaction thruster. The narrow end of keyhole-shaped opening 32 is installed to face the bow of the marine vessel (not shown) with which it is associated, and causes a large volume of seawater flow into the wider end of conical/tapered housing 8 substantially without drag or cavitation as the marine vessel moves in a forwardly direction. Although keyhole-shaped opening 32 can be enlarged, its shape is critical and the proportion shown is FIG. 4 must be substantially preserved. The critical keyhole shaped inlet opening 32, and its flush positioning within the bottom surface 24 of the associated marine vessel hull, affects the laminar flow of seawater moving across the hull. The keyhole-shaped opening 32 causes the laminar flow to form eddys at its outside edges and seawater to flow therein at the center of its leading edges. The eddys redirect the inertial energy to flow upward into conical/tapered housing 8, and induce the main flow of seawater to follow without protest. Due to the large amount of seawater induced to flow into keyhole-shaped opening 32, cavitation is eliminated as the seawater moves into conical/tapered housing 8 and upward toward propeller 4A, preventing steam bubbles that are low in temperature and pressure from forming. The flush mounting of cover plate 28 within the bottom surface 24 of a marine hull, as shown in FIG. 2, eliminates drag and reduces fuel consumption for the associated marine vessel (not shown). The thickness dimension of cover plate 28 is not critical, as long as the corresponding recess within bottom surface 24 positions it flush with the outside of bottom surface 24. Although not shown, for larger marine vessels it is contemplated for a grate and/or other appropriate material be secured across keyhole-shaped opening 32 to block the entrance of large objects through inlet opening 10, particularly to protect humans and large marine life from injury. The configuration of any safety means secured across keyhole-shaped opening 32 must preserve its ability to draw in a large amount of seawater into conical/tapered housing 8 without cavitation. FIG. 4 also shows a plurality of recessed apertures 62 adjacent to the perimeter of cover plate 28 that allow it to be placed flush within the bottom surface 24 of a marine hull. The number of recessed apertures 62 used is not critical as long as a strong and secure connection is achieved between cover plate 28 and the bottom surface 24 of a marine hull. Although not shown, gaskets, adhesive, bonding, and/or other connection enhancing means can also be used to achieve the desired leak proof connection between cover plate 28 and the bottom surface 24 of a marine hull. Further, while it is preferred for the interior configuration of inlet opening 10 to be non-angular, the perimeter configuration of cover plate 28 and the recessed opening within bottom surface 24 within which cover plate 28 is mounted do not have to be rectangular, and may be of any complementary shape desired. However, for manufacturing, cost, and ease of installation considerations, it is contemplated that a rectangular configuration would be most commonly used.

FIG. 5 shows the strut plate 38 used to secure and maintain strut 12 in a central position within conical/tapered housing 8 in the most preferred embodiment 2 of the present invention marine reaction thruster. Broken lines illustrate the top end of strut 12 attached to strut plate 38, that positions strut 12 in a downwardly extending and substantially perpendicular orientation from strut plate 38 within conical/ tapered housing 8. FIG. 5 also shows a plurality of fastener openings 22 through the perimeter of strut plate 38 through which fasteners 58, including oversized bolts, can be used to securely hold strut plate 38 against conical/tapered housing 8. The number of fastener openings 22 is not critical as long as a strong and secure connection is achieved between strut plate 38 and conical/tapered housing 8. The thickness dimension of strut plate 38 is not critical, as long as it is sufficiently strong to support strut 12 in a fixed position during high-speed rotation of propellers 4A–4D. Further, although not shown, gaskets and/or other connection enhancing means can also be used to achieve the desired leak proof connection between strut plate 38 and conical/tapered housing 8, however, it is contemplated for strut plate 38 to be periodically removable for maintenance access through upper opening 20 in conical/tapered housing 8. Further, the perimeter configurations of strut plate 38 and upper opening 20 do not have to be rectangular, and may be of any complementary shape desired, as long as sufficient space is preserved for maintenance access to strut 12, fastener/nut 58, the debris cutting member adjacent to strut 12, and perhaps the smallest propeller 4D. However, for manufacturing, cost, and ease of installation considerations, it is contemplated that a rectangular configuration would be most commonly used for strut plate 38.

Figure 6:
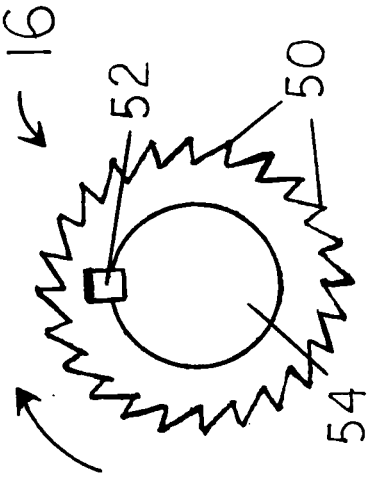
FIG. 6 is a side view of one preferred embodiment of debris cutter contemplated for use with the propellers and/or strut in the most preferred embodiment of the present invention marine reaction thruster with its cutting edges configured for right-hand rotation and a curved arrow showing the direction of its rotation, and with the cutter also having a means for a keyed attachment to the drive shaft upon which the propellers are mounted for movement in unison with the drive shaft and propellers.

FIG. 6 shows a preferred embodiment of debris cutting member 16 used in the present invention marine reaction thruster in association with each propeller 4A–4D, and optionally in front of strut 12. Debris cutting members 16 each have a central opening 54 configured for insertion therethrough of drive shaft 6 and a rectangular-shaped cutout 52 configured to mate with key 18 on drive shaft 6. The rectangular shapes of key 18 and cutout 52 are not critical, as long as their configurations cause debris cutting member 16 to rotate in unison with drive shaft 6. It is contemplated for the cutting edges 50 of debris cutter 6 to be very sharp so that debris in seawater drawn through inlet opening 10 is sufficiently shredded to avoid becoming wrapped around the propeller 4 or strut 12 behind it and creating drag. Also, since in the most preferred embodiment 2 of the present invention the motor (not shown) connected to drive shaft 6 would always have a left-hand rotation, an arrow in FIG. 6 shows the contemplated direction of rotation for all debris cutting members 16, and the uniform positioning of all sharp edges 50 on debris cutting members 16 in the direction of rotation. The materials from which debris cutting members 16 are made should be strong and corrosion-resistant, and a material that can hold a sharp edge so as to reduce maintenance. While the number of debris cutters used is not critical, periodic maintenance resulting from the need to clean drag-producing debris (not shown) from propellers 4A–4D is reduced by use of a debris cutting member 16 positioned for rotation in front of each successive propeller 4 and strut 12. It is considered to be within the scope of the present invention for the diameter dimension and configuration of cutting edges 50 of debris cutting members 16 to be selected according to the size of the propeller 4 or strut 12 with which it is being used. FIG. 7 shows the debris cutting member 16 positioned in front of strut 12 to be arger than the debris cutting members 16 positioned in front of propellers 4A–4D, however the sizes shown are not critical. Further, the thickness dimension of the debris cutting members used is not critical, and can vary according to the need.

FIG. 7 shows the conical/tapered housing 8 in the most preferred embodiment of the present invention marine reaction thruster having front casting 30 attached to its wider end and the reverse and steering assembly 34 attached to its opposing narrower end so that seawater exiting housing 8 through discharge opening 14 will travel through reverse and steering assembly 34. A series of arrows shows the direction of seawater flow into the wider end of conical/tapered housing 8, across propellers 4A, 4B, 4C, and 4D, exiting the narrow end of conical/tapered housing 8, and being directed by reverse and steering assembly 34 in both rearward and downward directions to place the associate marine vessel approximately in 'neutral'. FIG. 7 further shows inlet opening plate 28 being mounted flush within the outside of bottom surface 24 in a marine hull, and the narrow end of conical/tapered housing 8 being secured to transom 36 and aligned with the reverse and steering assembly 34. A manual control 60 for gate 48 is shown above reverse and steering assembly 34. The top end of strut 12 is secured across upper access opening 20 by at least one fastener 58 to strut plate 38, with the lower end of strut 12 secured by another fastener/nut 58 and maintaining the distal end of shaft 6 in a fixed central position within conical/tapering housing 8 during rotation of propellers 4A–4D. FIG. 7 also shows a debris cutting member 16 positioned in front of each propeller 4 and strut 12. Also, on the upper surface of conical/tapered housing 8, at a spaced-apart distance forward from strut plate 38, FIG. 7 shows an optional handling device 64 that can be configured for mating with a tool or device (not shown) that assists in manipulation of conical/tapered housing 8 during manufacture and/or installation. Further, adjacent to handling device 64, FIG. 7 also shows an inlet opening 72 for optional introduction of engine cooling water into the suction side of conical/tapered housing 8. Neither handling device 64, nor inlet opening 72, are critical. Connected to front casting 30 and positioned around drive shaft 6, FIG. 7 also shows a hose 70, a packing gland 68, and a coupler 66.

Figure 9:
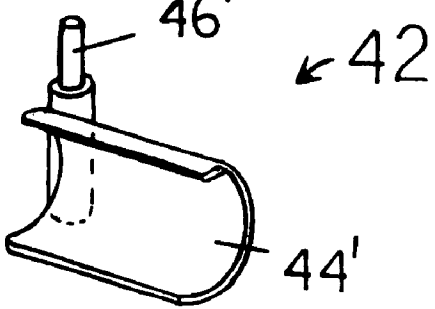
FIG. 9 is a perspective view of one of the crescent-shaped rudders in the most preferred embodiment of the present invention with its steering spindle attached to the back of the crescent shape at one of its ends.
Figure 8:
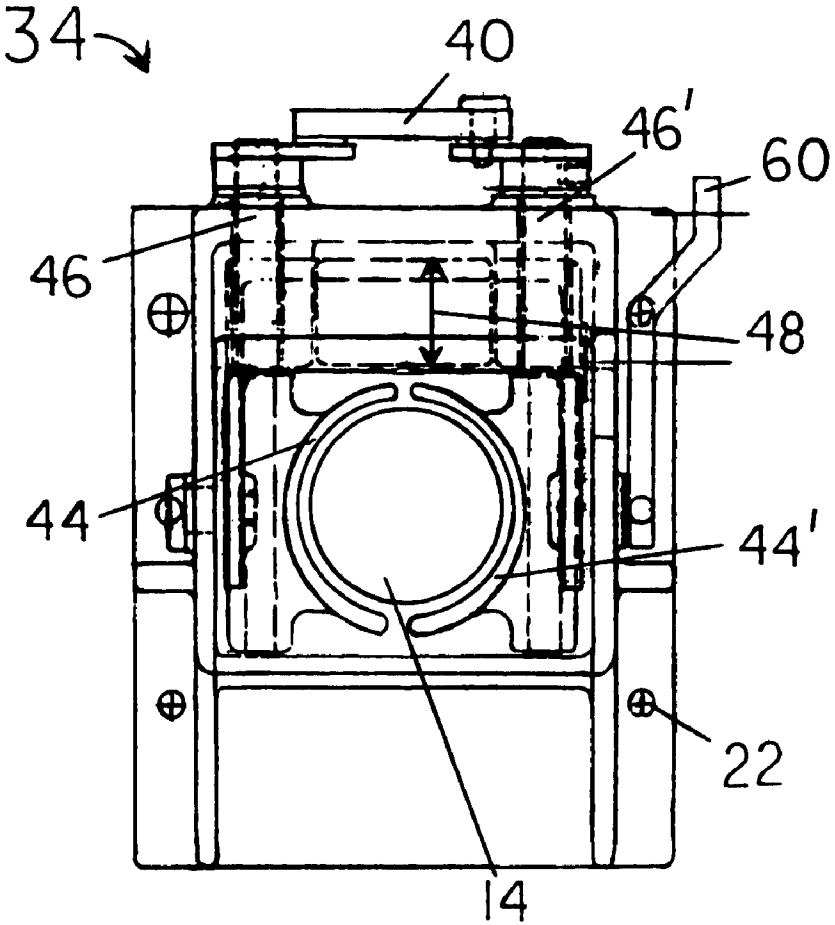
FIG. 8 is a rear view of the reverse and steering assembly in the most preferred embodiment of the present invention with its movable gate raised to reveal the discharge opening in the rear end of the conical/tapered propeller housing and the two centrally and opposingly positioned crescent-shaped rudders located immediately behind the discharge opening, and further with a handle connected to the gate and the spindles attached to the rudders being connected to one another by an upper tie bar.

FIG. 8 shows the positioning of two opposing crescent-shaped rudders 42 centrally within reverse and steering assembly 34 in the most preferred embodiment 2 of the present invention, with the discharge opening 14 in the narrow end of conical/tapered housing 8 shown concentric with them. Optimally in the most preferred embodiment 2 of the present invention, discharge opening 14 has approximately the same diameter dimension as the two opposing rudders 42, however the diameter of discharge opening 14 is shown smaller in FIG. 8 for enhanced visibility. In FIG. 8, one rudder 42 is distinguished by the spindle 46 and crescent-shaped configuration 44, while the second rudder 42 is distinguished by the spindle 46' and crescent-shaped configuration 44'. As implied by its designation, reverse and steering assembly 34 performs two functions. First, movable gate 48 can be lowered and raised to cause the 1 associated marine vessel to move in forward and reverse directions. Second, the associated marine vessel can be made to make left and right turns with rudders 42 that are configured with Ackerman geometry for non-symmetric movement. One rudder 42 would move more than the other in making a left hand turn, with the second rudder 42 moving more than the first in making a right hand turn. While FIG. 8 shows reverse and steering assembly 34 with movable gate 48 raised to reveal discharge opening 14 and the rudders 42 having a crescent-shaped configuration 44 and 44', FIG. 9 shows an enlarged view of the corresponding rudder 42 in FIG. 8 having spindle 46' through which its movement is achieved attached to the back of the crescent-shaped configuration 44' at one of its ends. The tie bar 40 is FIG. 8 connects the two spindles 46 and 46' together for coordinated operation of rudders 42 during turns. Rudders 42 can be used for steering when the associated marine vessel is moving in a forwardly direction, as well as in reverse. In addition, FIG. 8 shows fastener openings 22 used to connect reverse and steering assembly 34 to transom 36 (not visible in FIG. 8) and the handle 60 used for manual manipulation of gate 48. The size of reverse and steering assembly 34, and the thickness of the materials used for its construction, including gate 48 and rudders 42, should be proportionate to the force with which seawater is moved through discharge opening 14.

Figure 10:
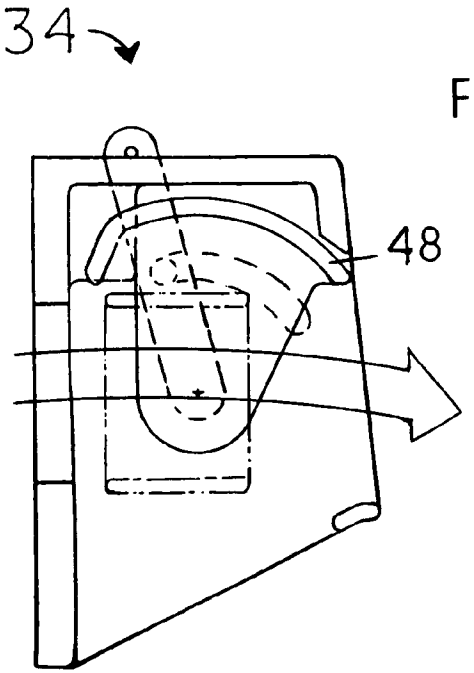
FIG. 10 is a side view of the reverse and steering assembly in the most preferred embodiment of the present invention marine reaction thruster with its movable gate in a fully opened position that allows seawater to move rearwardly beyond the reverse and steering assembly to cause forward movement of an associated marine hull.
Figure 11:
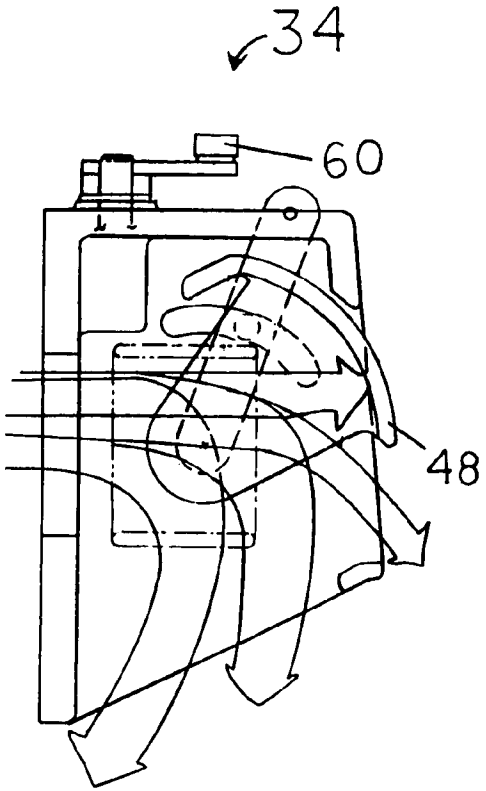
FIG. 11 is a side view of the reverse and steering assembly in the most preferred embodiment of the present invention marine reaction thruster in neutral, with its gate partially closed to cause some seawater moving through the reverse and steering assembly to be propelled rearwardly and some downwardly under an associated marine hull.
Figure 12:
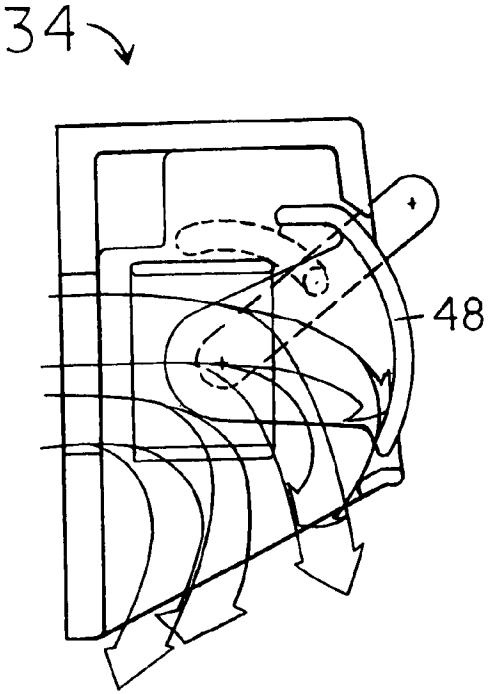
FIG. 12 is a side view of the reverse and steering assembly in the most preferred embodiment of the present invention marine reaction thruster with its gate in a fully closed position that causes all of the seawater to flow downward and forwardly under an associated hull for reverse marine vessel movement.

FIGS. 10–12 show the positioning of the movable gate 48 in reverse and steering assembly 34 that provides the forward and reverse movement of the associated marine hull in the most preferred embodiment 2 of the present invention marine reaction thruster. FIG. 10 shows gate 48 in a fully opened position that allows forward movement of the associated marine hull. One horizontally extending arrow shows the seawater moving through reverse and steering assembly 34 undeflected. FIG. 11 shows the partial closing of gate 48 that puts the associated marine hull substantially in neutral, whereby some seawater is propelled rearward and some downward under the marine hull. FIG. 12 shows gate 48 in a fully closed position that causes all of the seawater exiting conical/tapered propeller housing 8 to be propelled downward under the associated marine hull and cause it to move in reverse. Arrows in FIG. 11 show the rearward and downward direction of seawater flow, while arrows in FIG. 12 show rearward flow of seawater being blocked by gate 48. Manual control 60 for gate 48 is shown only in FIG. 11, although it or some other control for gate 48 would be present in all embodiments, even though not shown.

Figure 13:
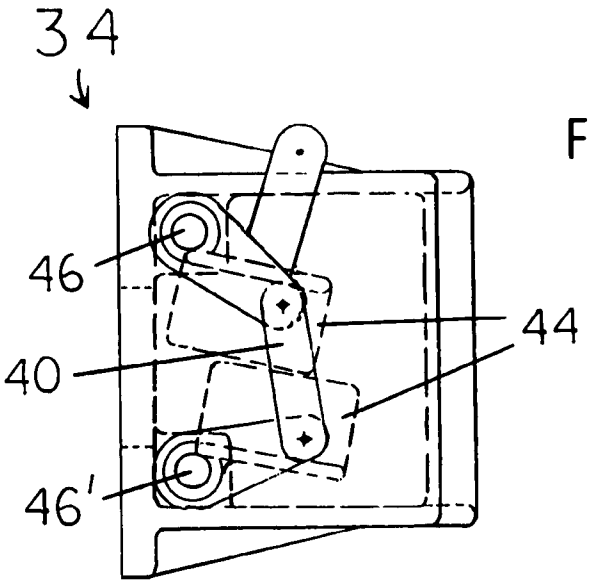
FIG. 13 is a plan view of the reverse and steering assembly in the most preferred embodiment of the present invention showing the Ackerman geometry of the rudders that allows the right rudder to move more than the left one, as revealed by the angled positioning of the tie bar, and cause less disruption of water for more efficient execution of a left turn by the associated marine hull.
Figure 14:
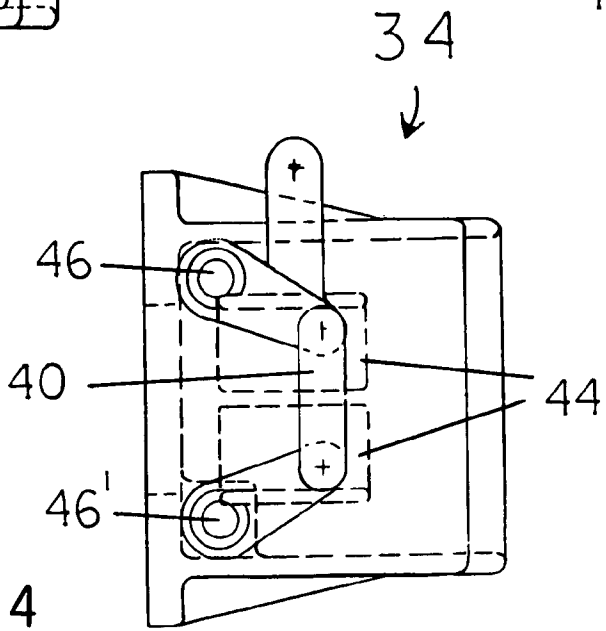
FIG. 14 is a plan view of the reverse and steering assembly in the most preferred embodiment of the present invention showing the symmetrical rudder positioning that provides forward movement of the associated marine hull.
Figure 15:
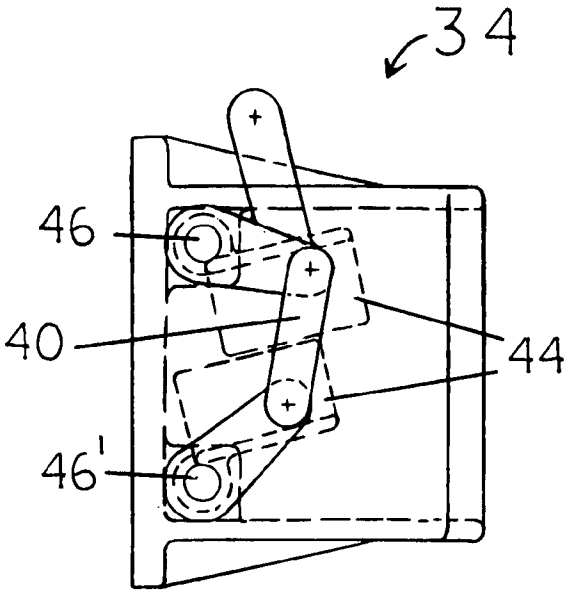
FIG. 15 is a plan view of the reverse and steering assembly in the most preferred embodiment of the present invention showing the Ackerman geometry of the rudders that allows the left rudder to move more than the right one, as revealed by the angled positioning of the tie bar, and cause less disruption of water for more efficient execution of a right turn by the associated marine hull.

FIGS. 13–15 show the Ackerman geometry of crescent-shaped rudders 42 that provides steering control in the reverse and steering assembly 34 of the most preferred embodiment 2 of the present invention. FIG. 13 shows the Ackerman geometry that allows the associated marine hull to efficiently execute a left turn, while FIG. 15 shows the Ackerman geometry that allows the associated marine hull to efficiently execute a right turn. FIG. 14 shows the geometry that provides forward movement of the associated marine hull. Further in each FIGS. 13–15, the spindles 46 and 46' connected to the crescent-shaped portions 44 of rudders 42 are shown secured to one another via tie bar 40. In FIG. 13, the crescent-shaped portion 44 of the rudder 42 attached to spindle 46 is moved more than the crescent-shaped portion 44 of the rudder 42 attached to spindle 46', with the reverse being shown in FIG. 15 for a right turn.

FIG. 16 shows diagram defining the maximum pitch angle for each of the increasingly smaller propellers 4A–4D of the present invention that are mounted on drive shaft 6 within conical/tapered housing 8, with reference to the circumference of each propeller 4A–4D and the theoretical distance it would travel in one revolution.

We claim:

1. A marine reaction thruster for use within a marine hull, said thruster comprising:

an elongated housing having a cross-sectional configuration and opposing ends, a drive shaft opening through one of said opposing ends and a discharge opening through the other of said opposing ends, a wide end adjacent to said drive shaft opening, a bottom fluid inlet opening in said wide end, an upper opening, a tapering central portion between said inlet opening and said upper opening, and a tapering narrow end between said upper opening and said discharge opening;

a drive shaft extending longitudinally through said housing between said drive shaft opening and said narrow end of said housing, said drive shaft having a distal end;

a plurality of propellers having different diameter dimensions, each of said propellers being supported by said drive shaft and positioned for rotation within said tapering central portion of said housing, with the largest one of said propellers being adjacent to said inlet opening and the remainder of said propellers being positioned according to decreasing size between said largest propeller and said upper opening, said diameter dimensions of said propellers being selected to substantially fill said cross-sectional configuration of said housing;

inflow inducing means adapted for causing a large volume of fluid to flow through said inlet opening of said housing and into said wide end of said housing;

at least one debris cutter supported by said drive shaft for rotation and said at least one debris cutter being positioned relative to said propellers so that debris in seawater entering said bottom fluid inlet opening of said housing is ground into smaller pieces before it has an opportunity to slow rotation of said propellers; and strut means associated with said upper opening in said housing and adapted for securing said distal end of said drive shaft so that the velocity of fluid moving across each successive one of said propellers is increased.

2. The thruster of claim 1 wherein said propellers are each positioned on said shaft at a pitch angle of between approximately 10° and 12°.

3. The thruster of claim 1 wherein said fluid inflow means comprises an inlet plate having a keyhole-shaped opening with a smaller end that is positioned in the direction of forward movement of the marine hull to which it is attached, said keyhole-shaped opening being aligned with said inlet opening in said housing, and recessed fastener openings, said keyhole-shaped opening having a wider end and being configured with outside edges designed to cause eddys to form and seawater to flow therethrough at the center portion of said outside edges.

4. The thruster of claim 3 wherein said inlet plate further comprises a plurality of recessed fastener openings for flush mounting within a marine hull.

5. The thruster of claim 1 further comprising a front casting connected to the one of said opposing ends of said housing having a drive shaft opening.

6. The thruster of claim 1 further comprising a reverse and steering assembly aligned with the one of said opposing ends of said housing having said discharge opening, and wherein said reverse and steering assembly comprises rudders and a movable gate selectively positioned to block reward flow of fluid exiting said discharge opening of said housing and traveling through said reverse and steering assembly.

7. The thruster of claim 6 wherein said rudders are connected by a tie bar and have Ackerman geometry that allows one to move more than the other and vice versa.

8. The thruster of claim 6 wherein said rudders have a crescent-shaped configuration.

9. The thruster of claim 1 wherein said at least one debris cutter further comprises a debris cutter being cutter being positioned adjacent to and forward of all said propellers.

10. The thruster of claim 1 wherein each said propeller has a hub, and further comprising at least one additional debris cutter supported by said drive shaft for rotation and cutting in the direction of rotation, with said at least one additional debris cutter being selected from a group consisting of cutters positioned at one of said hubs and forward of the next adjacent one of said propellers and cutters positioned forward of said strut.

11. A marine reaction thruster for use within a marine hull, said thruster comprising:

an elongated housing having a cross-sectional configuration and opposing ends, a drive shaft opening through one of said opposing ends and a discharge opening through the other of said opposing ends, a wide end adjacent to said drive shaft opening, a bottom fluid inlet opening in said wide end, an upper opening, a tapering central portion between said inlet opening and said upper opening, and a tapering narrow end between said upper opening and said discharge opening;

a drive shaft extending longitudinally between said drive shaft opening and said narrow end of said housing, said drive shaft having a distal end;

a plurality of propellers having different diameter dimensions, each of said propellers being supported by said drive shaft and positioned for rotation within said tapering central portion of said housing, with the largest one of said propellers being adjacent to said inlet opening and the remainder of said propellers being positioned according to decreasing size between said largest propeller and said upper opening, said diameter dimensions of said propellers being selected to substantially fill said cross-sectional configuration of said housing, and further wherein said propellers are each positioned on said drive shaft at a maximum pitch angle of 10° to 12° to eliminate outgassing and cavitation;

an inlet plate having a keyhole-shaped opening with a smaller end that is positioned in the direction of forward movement of the marine hull to which it is attached, said keyhole-shaped opening being aligned with said inlet opening in said housing, and recessed fastener openings, said keyhole-shaped opening having a wider end at rear and being configured with outside edges that widen from the smaller end causing eddys to form and seawater to flow therethrough at the center portion of said outside edges; and strut means associated with said upper opening in said housing and adapted for securing said distal end of said drive shaft so that the velocity of fluid moving across each successive one of said propellers is increased for a total thrust reaction in fluid exiting said discharge opening of at least twenty percent.

12. The thruster of claim 11 wherein said strut means comprises a strut plate configured for connection to said housing over said upper opening and a strut downwardly depending from said strut plate into said housing.

13. The thruster of claim 11 further comprising a reverse and steering assembly aligned with the one of said opposing ends of said housing having said discharge opening for fluid communication therebetween, and wherein said reverse and steering assembly comprises two crescent-shaped rudders with Ackerman geometry and a gate movable between a position that allows rearward flow of fluid from said reverse and steering assembly and a position whereby said rearward flow of fluid from said reverse and steering assembly is blocked.

14. The thruster of claim 11 wherein said rudders are connected by a tie bar and have Ackerman geometry that allows one to move more than the other in a selected turn and vice versa, while not creating drag or turbulence when in a steering mode.

15. The thruster of claim 11 further comprising at least one debris cutter supported by said drive shaft for rotation, with said at least one debris cutter being positioned relative to said propellers so that debris in seawater entering said inlet opening is ground into smaller pieces before it has an opportunity to slow rotation of said propellers.

16. A method of manufacturing a marine reaction thruster for a marine vessel having an engine and a hull, said method comprising the steps of:

providing a marine hull, an elongated housing having a wide end, a narrow end, and a tapering central portion therebetween, a drive shaft, inflow inducing means, strut means, at least one debris cutter, and a plurality of propellers each having a different diameter dimension sized for positioning said propellers within said tapering central portion of said housing at a spaced-apart distance from one another and said diameter dimensions of said propellers also being only slightly smaller than said housing when positioned within its tapering central portion;

creating a bottom fluid inlet opening in said housing adjacent to said wide end;

creating an upper opening in said housing between said central portion and said narrow end;

creating a drive shaft opening in said wide end;

creating a discharge opening in said narrow end;

securing said housing within said marine hull;

positioning said propellers on said drive shaft for rotation at maximum pitch angles of approximately 10° to 12° with pitch increases so as to maintain fluid velocity while increasing the discharge volume for increased thrust;

positioning said at least one debris cutter relative to said propellers so that debris in seawater entering said bottom fluid inlet opening is ground into smaller pieces before it has an opportunity to slow rotation of said propellers;

extending said drive shaft through said drive shaft opening in said housing so that said propellers are positioned within said tapering central portion of said housing and the largest one of said propellers is adjacent to said inlet opening;

using said strut means in association with said upper opening to secure said drive shaft and said propellers centrally within said tapering central portion of said housing; and aligning said inflow inducing means with said inlet opening so that a large volume of fluid is caused to flow through said inlet opening of said housing when said marine hull moves in a forwardly direction.

17. The method of claim 16 wherein said fluid inflow inducing means comprises an inlet plate having a keyhole-shaped opening with a wider end, a smaller end, and said wider end having outside edges designed to cause eddys to form and seawater to flow into therethrough at the center portion of said outside edges, and further comprising the step of positioning said smaller end in the direction of forward movement of said marine hull, and the step of aligning said keyhole-shaped opening with said inlet opening in said housing.

18. The method of claim 16 further comprising a step of providing a reverse and steering assembly thruster having rudders with Ackerman geometry and a gate movable between a position that allows rearward flow of fluid from said reverse and steering assembly and a position whereby said rearward flow of fluid from said reverse and steering assembly is blocked, and also comprising a step of aligning said reverse and steering assembly with said discharge opening in said housing.

19. The method of claim 18 wherein said rudders have a crescent-shaped configuration.

20. The method of claim 16 wherein said steps of creating, securing, positioning, and aligning are accomplished in a different order.

* * * * *